US005418342A

United States Patent [19]

Miller

[11] Patent Number: 5,418,342

[45] Date of Patent: May 23, 1995

[54] DOOR EDGE SENSING SWITCH

[75] Inventor: Bearge D. Miller, Concordville, Pa.

[73] Assignee: Miller Edge, Inc., Concordville, Pa.

[21] Appl. No.: 122,211

[22] Filed: Sep. 17, 1993

[51] Int. Cl.[6] ..... H01H 3/16

[52] U.S. Cl. ..... 200/61.43

[58] Field of Search ..... 200/61.43, 86 R; 49/27, 49/28

[56] References Cited

U.S. PATENT DOCUMENTS

| | | | |
|---|---|---|---|
| 2,740,856 | 4/1956 | Doeg | 200/61.43 |
| 3,133,167 | 5/1964 | Miller | 200/61.43 |
| 3,855,733 | 12/1974 | Miller | 200/61.43 X |
| 3,867,595 | 2/1975 | Ramsey et al. | 200/86 R |
| 4,019,004 | 4/1977 | Gute | 200/61.43 |
| 4,349,710 | 9/1982 | Miller | 200/61.43 |
| 4,396,814 | 8/1983 | Miller | 200/61.43 |
| 4,487,648 | 12/1984 | Miller | 156/227 |
| 4,908,483 | 3/1990 | Miller | 200/61.43 |
| 4,954,673 | 9/1990 | Miller | 200/61.43 |

*Primary Examiner*—J. R. Scott

*Attorney, Agent, or Firm*—Panitch Schwarze Jacobs & Nadel

[57] ABSTRACT

A sensing edge for causing a closing door to open by actuating a device upon force being applied to the sensing edge. The sensing edge includes an elongate outer sheath compressible upon application of external pressure. A sensor is positioned within the elongate outer sheath for sensing the application of force to the sheath. Upon force being applied to the sheath, the sensor actuates a device for controlling the door. The sheath includes an aperture extending through one of the end surfaces. Electrical conductors that are in electrical communication with the sensor extend through the aperture, outwardly from the one end surface beyond the side surface of the door and into the internal area of a track to which the door is mounted. The sensor includes a flexible hood which extends outwardly from one end surface of the sheath and into the track area. The hood has second and third apertures extending therethrough. An installer of the sensing edge can place the conductors through either one of the second and third apertures and therefore allow for the electrical conductors to be positioned proximate either the first or second side surface of the door such that the sensing edge is bilateral.

7 Claims, 2 Drawing Sheets

DOOR EDGE SENSING SWITCH

FIELD OF THE INVENTION

The present invention relates to a sensing edge, and more particularly, to a sensing edge that has an increased sensing area and that can be installed with the conductors placed on either the right or the left hand side of the door.

BACKGROUND OF THE INVENTION

Sensing edges for doors are, per se, generally well known. Such sensing edges generally include an elongate outer sheath in which a force sensing switch is positioned. Upon the application of force to the sheath, the force sensing switch actuates suitable control circuitry for controlling the movement of the door. The force sensing switch positioned within the sheath typically comprises a pair of flexible, electrically conductive sheets positioned on the upper and lower sides of a layer of nonconducting foam having a plurality of openings extending therethrough from the upper to the lower side. Upon application of force to the sheath, either or both of the conductive sheets are deflected into electrically conductive engagement with each other, to thereby actuate suitable control circuitry for controlling the door.

Conventional sensing edges, including the above described switch, are not as versatile or as responsive as that contemplated in the present invention. For instance, the typical sensing edge includes conductors attached to the sensor for transmitting the sensing signal to appropriate control circuitry. The conductors exit the sheath of the sensing edge usually through an aperture that is located either on the side surface of the sheath or on the top edge of the sheath. In addition, the aperture is placed at a point that is within the range of the sensor's ability to sense forces. This arrangement limits the use of the sensing edge in two ways.

First, because the conductors exit the sheath at a point within the sensing range, the sensor is not able to detect forces which are proximate to that area. In other words, the conductors inhibit the normal operation of the sensor and thus the sensor may be unable to fully function in the spot that the wires exit the sheath. This is important because often objects move into the area bounded by a side surface of the door and it is important that the sensing edge be able to function at that location.

Second, since many of the doors to which the sensing edge may be attached are movably mounted on a track, the placement of the conductors through the sheath at a point located outside of the track area is cumbersome to the installer. The wires must be tucked away so that the operation of the door along the track is not inhibited.

Another common problem with conventional sensing edges is their difficulty of installation. Since the conductors exit the sheath through an aperture that is located either on the end surface of the sheath or on the top edge of the sheath, the installer of the sensing edge must determine before installation whether he is working with circuitry that is going to be placed on the right hand side of the door, or on the left hand side. If the installer goes out to the job site and in the middle of an installation discovers that for some reason the control circuitry must be located on a different side of the door than was originally planned, he must then take the sensing edge that is currently in his possession and exchange it for another sensing edge which has the conductors placed on the other side. The reason for this is that since conductors exit the sheath from the end, the sensing edge is either a right-handed or left-handed edge. Where the sensor conductors exit the sheath from the top, they do so at a point which makes the edge unusable at that point, as described above. Also, placement of the conductors through the top of the sheath has proven troublesome since the conductors interfere with the proper operation of the door along the track.

The present invention is directed to a sensing edge for a door for sensing objects that come into contact with the sensing edge during door closing. The sensing edge in the present invention overcomes the problems inherent in the prior art in two ways. First, the present sensing edge has an increased sensing area due to the placement of the conductors through an end surface of the sheath. Second, two apertures are located in the hood of the sheath so that the installer of the sensing edge can place the conductors through either one of the apertures. This results in increased versatility since the side of the sensing edge with the aperture with the conductors extending therethrough can be positioned proximate either side surface of the door thereby making the sensing edge bilateral.

SUMMARY OF THE INVENTION

Briefly stated, the present invention comprises a sensing edge for causing a closing door to open by actuating a device upon force being applied to the sensing edge. The door has a leading edge surface, a first lateral side surface, and a second lateral side surface. The first and second side surfaces are oppositely disposed. The door is movably mounted on a track which guides the door through a range of motion between open and closed positions. The track is positioned proximate at least the first side surface and includes an internal area. The sensing edge comprises an elongate outer sheath which is compressible upon application of external pressure for being positioned adjacent to the leading edge surface of the door. The sheath includes a first wall defining a cavity, the wall includes first and second oppositely disposed end surfaces. One of the end surfaces includes an aperture extending therethrough. The end surface with the aperture and the first side surface of the door are coplanar when the sheath is positioned adjacent to the leading edge surface of the door. The other end surface and the second side surface of the door are coplanar when the sheath is positioned against the leading edge surface of the door. An elongate sensor is positioned within the cavity and detects an external force that is applied to the sheath. The sensor extends substantially along the entire length between the first and second end surfaces. At least one electrical conductor is in electrical communication with the sensor for connection with a circuit for controlling the actuation of the door when the sensor detects the application of force to the sheath. The conductor extends through the first aperture in the one end surface of the sheath and extends outwardly from the one end surface beyond the side surface of the door into the internal area of the track, whereby the extension of the conductor through the aperture in the one end surface of the sheath allows the sensor to detect forces applied to the sheath substantially between the first and second end surfaces.

In another aspect, the present invention comprises a sensing edge for causing a closing door to open by actuating a device upon force being applied to the sensing edge. The door has a leading edge surface, a first lateral side surface and a second lateral side surface, the first and second lateral side surfaces being oppositely disposed. The door is movably mounted on a track which guides the door through a range of motion between open and closed positions. The track is positioned proximate at least the first side surface and includes an internal area. The sensing edge comprises an elongate outer sheath compressible upon application of external pressure for being positioned adjacent to the leading edge surface of the door. The sheath includes a first wall defining a cavity, and the wall includes first and second oppositely disposed end surfaces. One of the end surfaces includes a first aperture extending therethrough. A plane extends generally parallel to the door when the door is in the closed position. The plane extends through the sheath and divides the sheath into first and second portions. An elongate sensor is positioned within the cavity and detects an external force applied to the sheath. The sensor extends substantially along the entire length between the first and second end surfaces. At least one electrical conductor is in electrical communication with the sensor for connection within a circuit for controlling the actuation of the door when the sensor detects the application of force to the sheath. The conductor extends through the first aperture in the one end surface of the sheath, and extends outwardly from the one end surface beyond the side surface of the door and into the internal area of the track. A flexible hood extends outwardly from the one end surface of the sheath and into the internal track area. The hood has second and third apertures extending through a wall of the hood. The second aperture is positioned on one side of the plane, and the third aperture is positioned on the other side of the plane. The conductor is positioned through one of the second and third apertures of the hood whereby an installer of the sensing edge can place the conductors through either one of the second and third apertures, and therefore allow for the first aperture to be positioned proximate either the first or second side surface of the door such that the sensing edge is bilateral.

BRIEF DESCRIPTION OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF PREFERRED EMBODIMENTS

Figure 1:
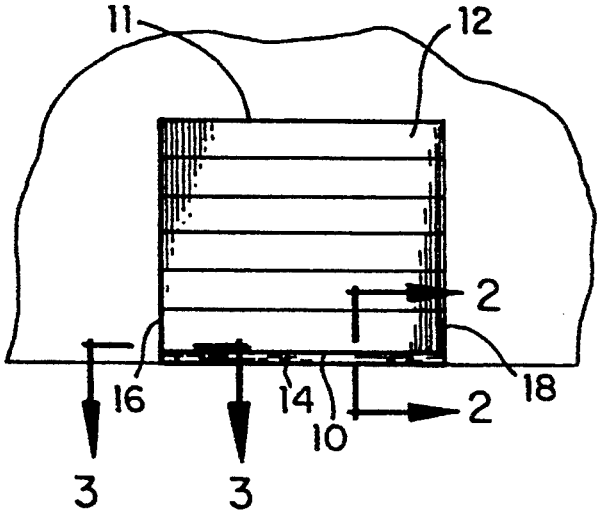
FIG. 1 is a front elevational view showing a door construction including a sensing edge in accordance with the present invention.

Certain terminology is used in the following description for convenience only and is not limiting. The words "right", "left", "upper", and "lower" designate directions in the drawings to which reference is made. The terminology includes the words above specifically mentioned, derivatives thereof and words of similar import.

Referring to the drawings in detail, wherein like numerals indicate like elements throughout, there is shown in FIGS. 1 through 5 a preferred embodiment of a sensing edge 10 in accordance with the present invention. There is shown in FIG. 1 a doorway 11 provided with a door 12. While the door 12, as illustrated, is an overhead door having a sensing edge 10 in accordance with the present invention along its lower side or leading edge surface 14, it is within the scope and spirit of the invention to incorporate the sensing edge 10 along the edge of any door structure, such as vertically disposed or horizontally moveable doors (not shown) as desired. Moreover, it is understood by those skilled in the art that the sensing edge 10 is not limited to use in connection with only doors, but can be used for other applications, such as automatic windows and gates.

The door 12 has a leading edge surface 14, a first lateral side surface 16 and a second lateral side surface 18. The first lateral side surface 16 and second lateral side surface 18 extend generally parallel with respect to each other, and are oppositely disposed. The door 12 is movably mounted on a track 20 (FIG. 3) which guides the door 12 through a range of motion. The track 20 is positioned proximate the first side surface 16 of the door 12 and includes an internal area 22.

Figure 3:
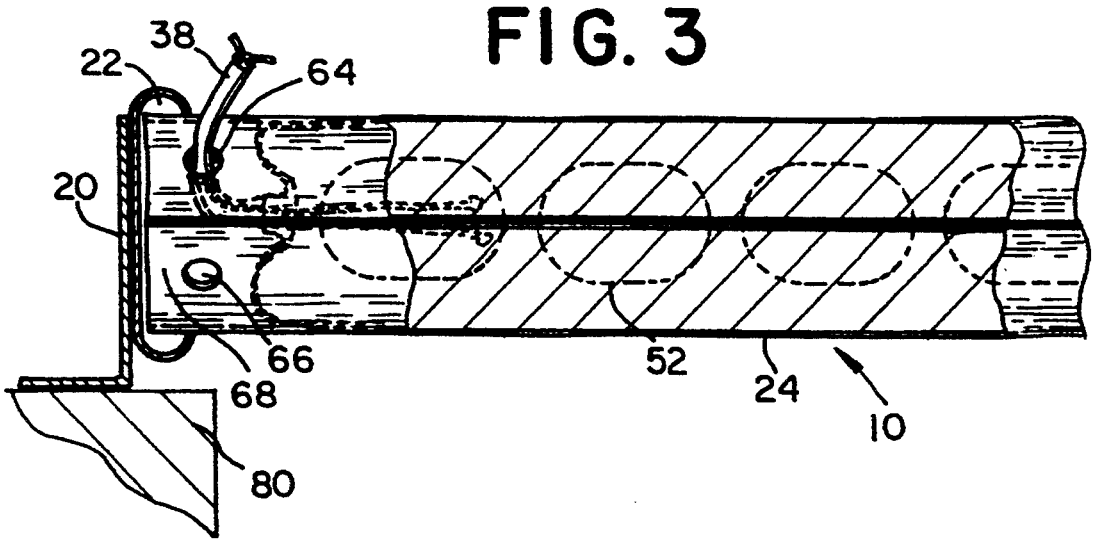
FIG. 3 is a cross-sectional view of the sensing edge taken along line 3—3 of FIG. 1.
Figure 5:
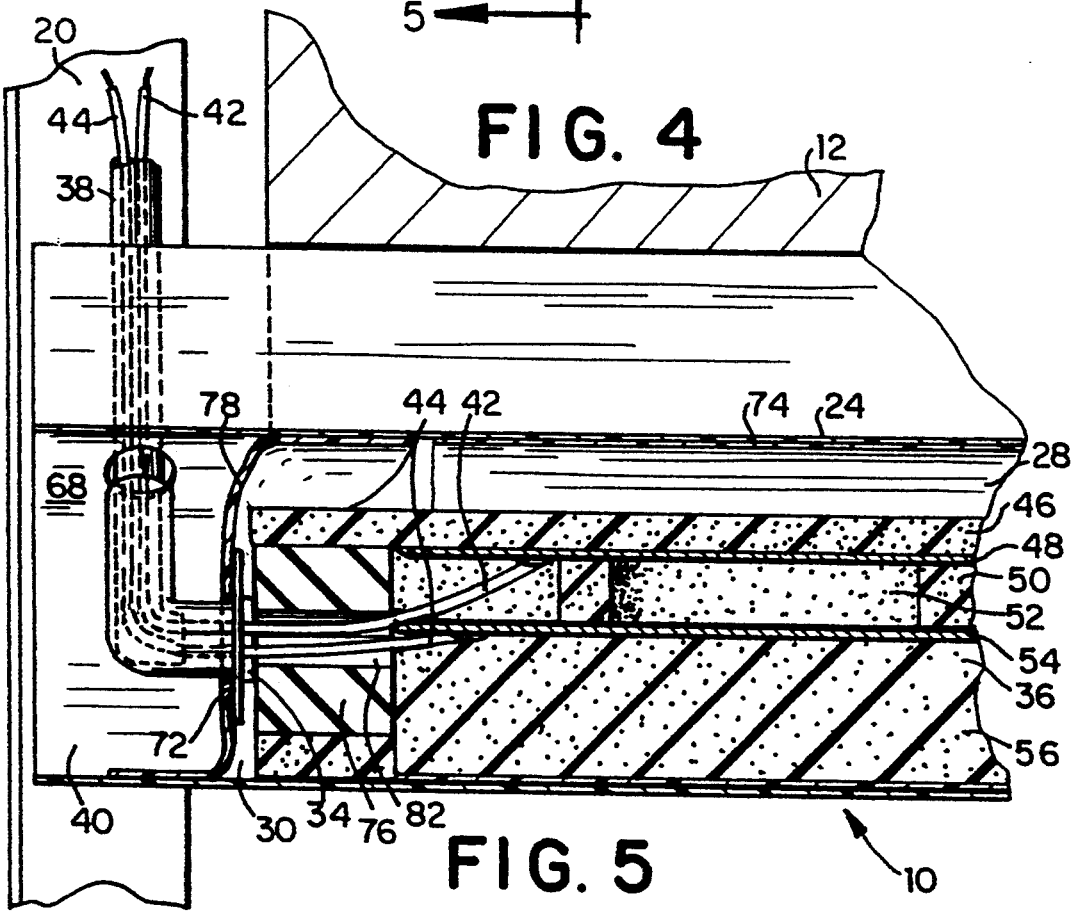
FIG. 5 is a cross-sectional view of a portion of the door and the sensing edge taken along line 5—5 of FIG. 4.

Referring to FIGS. 3 and 5, the track 20 is secured to a structural wall 80 which assists in defining the doorway 11 utilizing standard fasteners (not shown) in the conventional fashion. In the preferred embodiment, the track 20 is positioned vertically along the structural wall 80 so that the door 12 is able to move up and down the track 20. In the preferred embodiment, the track also includes rollers (not shown) to assist in the motion of the door. The rollers are usually attached or mounted to the first and second lateral side surfaces 16, 18 of the door 12 in the conventional fashion, and guided through the track 20. It is preferred that two tracks (only one is shown) be utilized in order to obtain smooth movement of the door 12. However, it is understood by those skilled in the art, that only one track may be mounted on either the left or right-hand side of the door 12, without departing from the scope or spirit of the invention.

Figure 2:
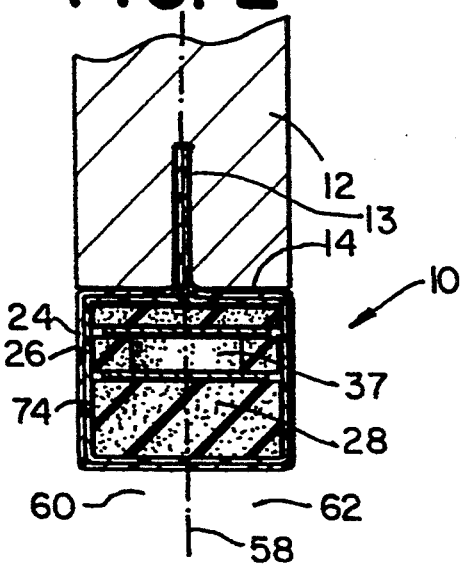
FIG. 2 is a cross-sectional view of a portion of the door and the sensing edge taken along line 2—2 of FIG. 1.

Referring now to FIG. 2, the sensing edge 10 and the door 12 include securing means for fixing or attaching the sensing edge 10 to the leading edge surface 14 of the door 12. In the embodiment shown, the sensing edge 10 is secured to the door 12 via a securing member 13, which extends outwardly from the sensing edge 10 and into a suitably sized groove in the door 12. It will be appreciated that the securing member 13 may be secured within the suitably sized groove by use of a friction fit, adhesive substance, or any other conventional securing means. The securing member 13 is formed from a one-step sealing process utilized in the manufacture of the sensing edge 10, as disclosed in U.S. Pat. No. 4,396,814, which is hereby incorporated by reference. Note that the sensing edge 10 may also be secured to the door 12 in any other suitable manner, for instance, with a traditional dovetail slot configuration (not shown) or using one of the configurations shown in U.S. Pat. No. 5,124,511. Moreover, it is also within the spirit and scope of the invention to secure the sensing edge 10 to the leading edge surface 14 of the door 12 by an adhesive (not shown) applied between the leading door edge surface 14 and the peripheral face of the sensing edge 10.

Referring now to FIGS. 2 and 3, the sensing edge 10 is comprised of an elongate outer sheath 24 which is compressible upon application of external pressure. The sheath 24 forms a wall with a cavity 28. It is preferred that the sheath 24 have a generally constant cross-sectional outline, extending closely along the leading edge surface 14 of the door 12. In the present embodiment, the sheath 24 is generally of rectangular cross-section, but may be of any other suitable shape, such as circular or semi-circular (not shown). Referring to FIG. 2, the securing member 13 is an extension of the outer sheath 24, and extends generally in a direction away from the body of the sheath 24, so that the sensing edge 10 can be mounted in the door 12.

In the present embodiment, it is preferred that the sheath 24 be advantageously fabricated of a form-retaining, but flexible material, such as rubber. However, it is understood by those skilled in the art, that the sheath can be made of any form-retaining, flexible material, such as elastomeric material.

Referring to FIGS. 2 and 5, the elongate outer sheath 24 also includes an inner sheath 74. The inner sheath 74 is positioned within the cavity 28 in facing engagement with the internal surface of the outer sheath 24. The inner sheath 74 has the same characteristics as the outer sheath 24.

In the present embodiment, it is preferred that the sheath 24 include a first sheath seal 78 and a second sheath seal (not shown) each having a first end surface 30 and a second end surface, respectively. The first and second sheath seals 78 are preferably constructed of the same material as the sheath 24. The first end surface 30 and first sheath seal 78 include an aperture 34 extending therethrough. The first and second sheath seals are formed from a series of steps which are described in U.S. Pat. No. 4,396,814. The sensing edge 10 is secured to the leading edge surface 14 of the door 12 such that the first end surface 30 and the first side surface 16 of the door 12 are generally coplanar when the sensing edge 10 is positioned adjacent to the leading edge surface 14 of the door 12, and the second end surface (not shown) and the second side surface 18 of the door 12 are also generally coplanar when the sensing edge 10 is positioned adjacent to the leading edge surface 14 of the door 12.

In the preferred embodiment, the sheath 24 further includes a hood 40. The hood 40 extends outwardly from the first end surface 30 and into the internal area 22 of the track 20. The hood 40 is formed as a result of the positioning of the end surface 30 along an inner portion of the sensing edge 10. The extension of the hood allows for the protection of the electrical conductors 42, 44 during the use of the sensing edge 10. The general shape of the hood 40 conforms to that of the sheath 24, that is, it is generally flat on the section which comes into contact with the ground (not shown), and extends upwardly in a circumferential fashion until it joins with the securing member 13.

In the preferred embodiment, the hood 40 is hollow and extends outwardly from the first end surface 30 of the sheath 24 in such a way that it does not interfere with the operation of the movement of the door 12 along the track 20 when the door 12 is opening or closing. It is also understood that the hood 40, as shown in FIG. 5, is preferably constructed of the same material as the sheath 24. However, the present invention is not limited to constructing the hood 40 to the same material as the sheath 24. The hood 40 can be made of any suitable material in order to accommodate the particular requirements of the sensing edge 10 in a given installation.

Referring to FIGS. 2 and 5, a sensor 36 runs the entire length of the sensing edge 10 from the first lateral side surface 16 to the second lateral side surface 18. Through this construction, the inner sheath 74 protects the sensor 36 from exposure to the external elements should the outer sheath become torn, or ruined from abuse, misuse or accident. The sensor substantially occupies the cavity 28 of the sheath 24. In the preferred embodiment, the sensor comprises a standard multi-layered force sensing switch 37 as described below.

In the preferred embodiment, the force sensing switch 37 comprises a first sheet of resiliently compressible material 46 which is positioned within the sheath 24 and includes a first face and a second face. The first face of the first sheet of resiliently compressible material 46 is in engagement or corresponding facing relationship with the upper wall 26 of the sheath 24. In the present embodiment, it is preferred that the first sheet of resiliently compressible material 46 and succeeding layers and sheets, described hereinafter, be generally sized to complement the internal configuration of the sheath 24. However, it is understood by those skilled in the art, that the first sheet of resiliently compressible material 46 and succeeding layers can be sized as wide or as narrow as desired, and be virtually of any length for accommodating different structures and uses.

In the present embodiment, it is preferred that the first sheet of resiliently compressible material 46 be constructed of generally soft foam rubber. It is understood by those skilled in the art, that the first sheet of resiliently compressible material 46 can be constructed of either closed or open cell foam rubber or of other materials having similar properties.

Just below (when viewing FIGS. 2 and 5) the first sheet of resiliently compressible material 46 is a first sheet pf flexible, electrically conductive material 48, engaged therewith, and having a first and a second face. The first face of the first sheet of flexible, electrically conductive material 48 is in engagement or in corresponding facing relationship with the second face of the first sheet of resiliently compressible material 46.

In the present embodiment, it is preferred that the first sheet of flexible, electrically conductive material 48, be generally thin and preferably be constructed of aluminum or aluminum foil. However, it is within the spirit and scope of the invention, to construct the first sheet of flexible, electrically conductive material 48 of other materials, such as copper or brass.

As shown in FIG. 5, an electrical conductor or wire 42 is electrically connected to the first sheet of flexible, electrically conductive material 48 preferably by soldering at one end thereof. The electrical conductor 42 is used in conjunction with a circuit (not shown) for controlling the actuation of a device (described hereinafter) or door 12 as is understood by those skilled in the art, in response to the application of force to the sheath 24, as described hereinafter.

The first sheet of flexible, electrically conductive material 48 is in engagement with a layer of non-conductive material 50 having a first face and a second face for spacing apart the first sheet of flexible electrically conductive material 48 and a second sheet of flexible, electrically conductive material 54, described hereinafter. The first face of the layer of non-conductive material 50 is in engagement or corresponding facing relationship with the second face of the first sheet of flexible, electrically conductive material 48.

The layer of non-conductive material 50 has at least one opening 52 extending therethrough between the first and second faces thereof. As shown in FIG. 5, the layer of non-conductive material 50 preferably includes a plurality of spaced openings 52 interspersed along the entire length thereof for allowing the actuation of the force sensing switch 37 by applying pressure thereto, as described hereinafter. In the present embodiment, it is preferred that the openings 52 be generally oval-shaped in cross-section. However, it is in the spirit and scope of the invention to configure the openings 52 of any geometric shape, such as square or circular.

The layer of non-conductive material 50 is preferably constructed of generally soft foam rubber. It is understood by those skilled in the art, that the layer of non-conductive material 50 can be constructed of either closed or open cell foam or other materials having similar properties so long as the function of the force sensing switch 37 is achieved, as described hereinafter.

The layer of non-conductive material 50 is in engagement with a second sheet of flexible, electrically conductive material 54 having a first face and a second face. The first face of the second sheet of flexible, electrically conductive material 54 is in engagement or in corresponding facing relationship with the second face of the layer of non-conductive material 50.

In the present embodiment, it is preferred that the second sheet of flexible, electrically conductive material 54 be constructed of the same material and configuration as the first sheet of flexible, electrically conductive material 48. Similarly, the second sheet of flexible, electrically conductive material 54 is connected to an electrical conductor or wire 44 for connection with a circuit for controlling the actuation of the door 12 or device in response to the application of force to the sheath 24.

In engagement with the second sheet of flexible, electrically conductive material 54 is a second sheet of resiliently compressible material 56 having a first face and a second face. The first face of the second sheet of resiliently compressible material 56 is in engagement or corresponding facing relationship with the second face of the second sheet of flexible, electrically conductive material 54.

The second sheet of resiliently compressible material 56 is preferably constructed of the same material and configured generally identically to the first sheet of resiliently compressible material 46, except that it has a greater thickness. However, it is apparent to those skilled in the art, that the first and second sheets of resiliently compressible material 46, 56 can differ in configuration, size and/or material.

In the preferred embodiment, a stopping block 76 is positioned within the sheath 24. The stopping block 76 includes a block aperture 82 and is positioned between the first end surface 30 of the sheath 24 and the sensor 36. The block aperture 82 allows for the passage of first and second electrical conductors 42, 44 through the stopping block 76, as described below. In the preferred embodiment, a second stopping block (not shown) is positioned proximate the second end surface (not shown) of the sheath 24. Because of the dual stopping block arrangement, the weight of the door 12 will not activate the sensor 36 when the door makes contact with the ground surface (not shown). That is, the weight of the door 12 in the closed position is borne by the stopping blocks 76 and not the sensor 36. It is appreciated by those skilled in the art that the stopping block 76 may be constructed of any noncompressible substance, such as hardened rubber, stiffened plastics, or synthetic resins. However, in order not to interfere with the operation of the sensor 36, the stopping block 76 is positioned within the sheath 24 such that it remains outside the sensing range of the sensor 36.

Figure 4:
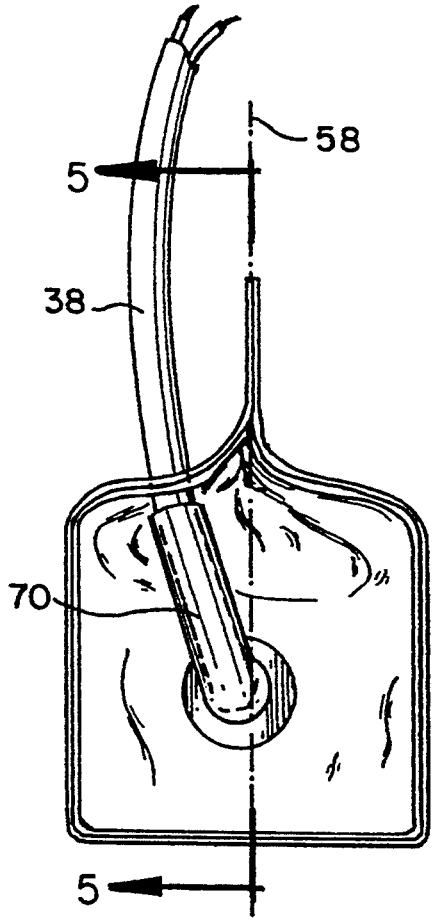
FIG. 4 is a greatly enlarged left end view of the sensing edge of FIG. 1.

Referring to FIGS. 2 and 4, a plane 58 extends through the first end surface 30 of the sheath 24. The plane 58 extends generally parallel to the door 12 when the door 12 is in the closed position. The plane 58 divides the sheath 24 into a first portion 60 and a second portion 62. In the preferred embodiment, the plane 58 divides the sheath 24 into generally equal first and second portions 60, 62.

Referring to FIGS. 3 and 5, the hood 40 which extends outwardly from the first end surface 30 of the sheath 24 has a second aperture 64 and a third aperture 66. The apertures 64, 66 extend through a wall 68 of the hood 40 such that the second aperture 64 is positioned on one side of the plane 58 and the third aperture 66 is positioned on the other side of the plane 58.

Referring to FIGS. 4 and 5, an elbow 70 extends outwardly from the sheath 24. The elbow 70 is hollow, and is securely attached to the first sheath seal 78 of the sheath 24, as described below. Since the first sheath seal 78 is flexible the elbow 70 is capable of limited motion, so that the electrical conductors 42, 44 which are placed therethrough may be routed through either one of the second or third apertures 64, 66. It is generally preferred that the elbow 70 be constructed of a semirigid plastic so as to facilitate the assembly of the apparatus, but those skilled in the art will appreciate that the elbow 70 can be made of any suitable material.

Positioned in between the stopping block 76 and the sheath seal 78 is a flange 72. The flange 72 is an extension of the elbow 70, and sealingly engages the internal surface of the first sheath seal 78 to provide a fluid impervious barrier so that the sensor 36 is protected from outside elements such as air, water, and other liquids or solid material. It should be appreciated by those skilled in the art that other means for providing a sealed protective barrier for the sensor 36 are possible without departing from the spirit and scope of the invention.

Referring to FIG. 5, in the present embodiment, at least one electrical conductor extends through the aperture 34 in the first end surface 30 of the sheath 24. More particularly, the electrical conductors 42, 44, which are electrically connected to the first and second sheets of electrically conductive material 48, 54, respectively, extend through the block aperture 82, the aperture 34 in the first sheath seal 78, elbow 70 and one of the second and third apertures 64, 66. The electrical conductors 42, 44 are preferably housed within a casing 38 to facilitate feeding the electrical conductors 42, 44 through the above-mentioned elements. The electrical conductors 42, 44 extend outwardly from the first end surface 30 of the sheath 24 beyond the side surface 16 of the door 12 and into the internal area 22 of the track 20. This allows the sensor 36 to extend almost the entire length of the door 12.

In the present embodiment, it is preferred that the aperture 34 be of generally circular shape, so as to accommodate the usual forms of commercially available conductors or cabling. However, it is understood by those skilled in the art, that the aperture 34 can be shaped in any other suitable form, such as square, rectangular, or oval (not shown).

In the present embodiment, it is preferred that the second and third apertures 64, 66 be of generally circular shape, so as to accommodate the usual forms of commercially available conductors or cabling. However, it is understood by those skilled in the art, that the aperture can be shaped in any other suitable form, such as square, rectangular, or oval (not shown).

In the present embodiment, it is preferred that the second and third apertures 64, 66 be positioned such that they line up across from each other on opposite sides of the plane 58. This arrangement provides the installer of the sensing edge 10 the greatest amount of flexibility when deciding which way to place the edge 10 along the door 12. For instance, if the electrical conductors 42, 44 were to be positioned along the first side surface 16 of the door 12, then the conductor 38 would be fed through the second aperture 64 of the hood 40 as shown in FIG. 3. Conversely, if the electrical conductor 38 were to be positioned along the second side surface 18 of the door 12, then the conductor 38 would be fed through the third aperture 66 of the hood 40.

It will be noted by those skilled in the art that the positioning of second and third apertures 64, 66 opposite one another and separated by plane 58 is not limiting. The apertures 64 and 66 can be placed along any portion of the hood 40 which is suitable for the particular installation of the sensing edge 10.

From the foregoing description, it can be seen that the present invention comprises a sensing edge 10 for causing a closing door 12 to open by actuating a device upon force being applied to the sensing edge 10. The sensing edge 10 of the present invention overcomes the problems inherent in the prior art by first, providing an increased sensing area due to the placement of the conductors 42, 44 through an end surface 30 of the sheath 24, and second, by providing two apertures 64, 66 in the hood 40 of the sheath 24 so that an installer of the sensing edge can place the conductors through either one of the apertures, thus making the sensing edge 10 bilateral.

In operation, the electrical conductors or wires 42, 44 are connected to a circuit (not shown) for controlling the actuation of a device (not shown) and/or for controlling the operation of the door 12 in response to the application of force to the sheath 24. Specifically, upon the application of force to the exterior surface of the sheath 24, a portion of at least one of the first and second sheets of flexible, electrically conductive material 48, 54 deflects into at least one of the openings 52 in the layer of non-conductive material 50 and makes electrical contact between the first and second sheets of flexible, electrically conductive material 48, 54 to thereby complete or enable the circuit to actuate the device and/or control the operation of the door 12.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A sensing edge for causing a closing door to open by actuating a device upon force being applied to the sensing edge, the door having a leading edge surface, a first lateral side surface and a second lateral side surface, the first and second lateral side surfaces being oppositely disposed, the door being movably mounted on a track which guides the door through a range of motion, the track being positioned proximate at least the first lateral side surface and including an internal area, the sensing edge comprising:

an elongate outer sheath compressible upon application of external pressure for being positioned adjacent to the leading edge surface of the door, the sheath including a first wall defining a cavity, the wall including first and second oppositely disposed end surfaces, one of said end surfaces including an aperture extending therethrough, the end surface with the aperture and the first side surface of the door being generally coplanar when the sheath is positioned adjacent the leading edge surface of the door, the other end surface and the second side surface of the door being generally coplanar when the sheath is positioned adjacent the leading edge surface of the door;

an elongate sensor positioned within the cavity and detecting an external force applied to the sheath, said sensor extending substantially along the entire length between said first and second end surfaces; and at least one electrical conductor in electrical communication with the sensor for connection within a circuit for controlling the actuation of the door when the sensor detects the application of force to the sheath, the conductor extending through the aperture in the one end surface of the sheath and extending outwardly from the one end surface beyond the side surface of the door into the internal area of the track.

2. The sensing edge as recited in claim 1, wherein the sheath further includes a flexible hood extending outwardly from the one end surface into the internal area of the track.

3. The sensing edge as recited in claim 1, wherein the at least one electrical conductor comprises first and second electrical conductors and said sensor comprises:

a first sheet of resiliently compressible material having a first face and a second face, said first face of said first sheet of resiliently compressible material being in engagement with the wall of the sheath;

a first sheet of flexible, electrically conductive material having a first face and a second face, said first face of said first sheet of flexible, electrically conductive material being in engagement with said second face of said first sheet of resiliently compressible material, said first sheet of flexible, electrically conductive material being in engagement with said first electrical conductor;

a layer of non-conductive material having a first face and a second face, said first face of said layer of non-conductive material being in engagement with said second face of said first sheet of flexible, electrically conductive material, said layer of non-conductive material including at least one opening extending therethrough between said first and second faces thereof;

a second sheet of flexible, electrically conductive material having a first face and a second face, said first face of said second sheet of flexible, electrically conductive material being in engagement with said second face of said layer of non-conductive material, said second sheet of flexible, electrically conductive material being in engagement with said second electrical conductor;

a second sheet of resiliently compressible material having a first face and a second face, said first face of said second sheet of resiliently compressible material being in engagement with said second face of said second sheet of flexible, electrically conductive material, said second face of said second sheet of resiliently compressible material being in engagement with the wall of said sheath, said first and second sheets of flexible, electrically conductive material being spaced apart by said layer of non-conductive material and presenting opposed portions to each other through said opening whereby upon the application of force to said sheath, a portion of at least one of said first and second sheets of flexible, electrically conductive material deflects into the opening in said layer of non-conductive material and makes electrical contact between said first and second sheets of flexible, electrically conductive material, to thereby actuate the device.

4. A sensing edge for causing a closing door to open by actuating a device upon force being applied to the sensing edge, the door having a leading edge surface, a first lateral side surface and a second lateral side surface, the first and second lateral side surfaces being oppositely disposed, the door being movably mounted on a track which guides the door through a range of motion between open and closed positions, the track being positioned proximate at least the first side surface and including an internal area, the sensing edge comprising:

an elongate outer sheath compressible upon application of external pressure for being positioned adjacent to the leading edge surface of the door, the sheath including a first wall defining a cavity, the wall including first and second oppositely disposed end surfaces, one of said end surfaces including a first aperture extending therethrough, a plane extending generally parallel to the door when the door is in the closed position extending through the sheath and dividing the sheath into first and second portions;

an elongate sensor positioned within the cavity and detecting an external force applied to the sheath, said sensor extending substantially along the entire length between said first and second end surfaces;

at least one electrical conductor in electrical communication with the sensor for connection within a circuit for controlling the actuation of the door when the sensor detects the application of force to the sheath, the conductor extending through the first aperture in the one end surface of the sheath, and extending outwardly from the one end surface beyond the side surface of the door and into the internal area of the track; and a flexible hood extending outwardly from the one end surface of the sheath and into the internal track area, the hood having second and third apertures extending through a wall of the hood, the second aperture being positioned on one side of the plane and the third aperture being positioned on the other side of the plane, the conductor being positioned through one of the second and third apertures of the hood whereby an installer of the sensing edge can place the conductors through either one of the second and third apertures and therefore allow for the conductor to be positioned proximate either the first or second side surface of the door such that the sensing edge is bilateral.

5. The sensing edge as recited in claim 4, wherein the at least one electrical conductor comprises first and second electrical conductors and said sensor comprises:

a first sheet of resiliently compressible material having a first face and a second face, said first face of said first sheet of resiliently compressible material being in engagement with the wall of the sheath;

a first sheet of flexible, electrically conductive material having a first face and a second face, said first face of said first sheet of flexible, electrically conductive material being in engagement with said second face of said first sheet of resiliently compressible material, said first sheet of flexible, electrically conductive material being in electrical communication with said first electrical conductor;

a layer of non-conductive material having a first face and a second face, said first face of said layer of non-conductive material being in engagement with said second face of said first sheet of flexible, electrically conductive material, said layer of non-conductive material including at least one opening extending therethrough between said first and second faces thereof;

a second sheet of flexible, electrically conductive material having a first face and a second face, said first face of said second sheet of flexible, electrically conductive material being in engagement with said second face of said layer of non-conductive material, said second sheet of flexible, electrically conductive material being in electrical communication with said second electrical conductor;

a second sheet of resiliently compressible material having a first face and a second face, said first face of said second sheet of resiliently compressible material being in engagement with said second face of said second sheet of flexible, electrically conductive material, said second face of said second sheet of resiliently compressible material being in engagement with the wall of said sheath, said first and second sheets of flexible, electrically conductive material being spaced apart by said layer of non-conductive material and presenting opposed portions to each other through said opening whereby upon the application of force to said sheath, a portion of at least one of said first and second sheets of flexible, electrically conductive material deflects into the opening in said layer of non-conductive material and makes electrical contact between said first and second sheets of flexible, electrically conductive material, to thereby actuate the device.

6. The sensing edge as recited in claim 4, wherein the plane divides the sheath into substantially equal first and second portions.

7. The sensing edge as recited in claim 4, wherein the second and third apertures extend through the wall of the hood proximate the leading edge of the door.

* * * * *